US011792900B2

(12) United States Patent
Chen et al.

(10) Patent No.: US 11,792,900 B2
(45) Date of Patent: Oct. 17, 2023

(54) HIGH RESOLUTION DIMMER CIRCUIT

(71) Applicant: RICHTEK TECHNOLOGY CORP., Hsinchu County (TW)

(72) Inventors: Ching-Yi Chen, Hsinchu County (TW); Hsing-Shen Huang, Hsinchu County (TW)

(73) Assignee: RICHTEK TECHNOLOGY CORP., Hsinchu County (TW)

( * ) Notice: Subject to any disclaimer, the term of this patent is extended or adjusted under 35 U.S.C. 154(b) by 0 days.

(21) Appl. No.: 17/973,526

(22) Filed: Oct. 25, 2022

(65) Prior Publication Data

US 2023/0141723 A1 May 11, 2023

Related U.S. Application Data

(60) Provisional application No. 63/263,744, filed on Nov. 8, 2021.

(30) Foreign Application Priority Data

Oct. 3, 2022 (TW) ..... 111137467

(51) Int. Cl.
*H05B 45/325* (2020.01)
*H05B 45/10* (2020.01)

(52) U.S. Cl.
CPC ..... *H05B 45/325* (2020.01); *H05B 45/10* (2020.01)

(58) Field of Classification Search
CPC .. H02M 1/0845; H02M 3/156; H02M 1/0012; H02M 1/007; H02M 1/008; H02M 3/157; H02M 3/1588; H02M 3/00; H02M 1/084; H03M 5/08; H05B 41/2828; H05B 33/12; H05B 45/10; H05B 45/325; H05B 45/345; G09G 3/20; G09G 3/3241; G09G 2300/043; G09G 2300/0861; G09G 2310/0262; G09G 2354/00; G09G 2360/142; G09G 3/3208; G09G 3/3233; G09G 3/3258; G09G 2310/0248; G09G 2310/027; G09G 2310/0289; G09G 2310/0297; G09G 2320/0223; G09G 2320/0238; G09G 2320/0242; G09G 2320/0247; G09G 2320/0252;
(Continued)

(56) References Cited

U.S. PATENT DOCUMENTS

2004/0095108 A1* 5/2004 Kernahan ..... H03K 23/005 323/282
2007/0046587 A1* 3/2007 Takahara ..... G09G 3/325 345/76
2022/0293049 A1* 9/2022 Godo ..... H01L 27/1207

* cited by examiner

*Primary Examiner* — Monica C King
(74) *Attorney, Agent, or Firm* — Winston Hsu

(57) ABSTRACT

A dimmer circuit includes a light emitting module, a first current source, a digital-to-analog converter, a switch, a second current source and a pulse width modulation generator. The light emitting module is for emitting light according to a driving current. The first current source includes a first terminal coupled to a second terminal of the light emitting module. The digital-to-analog converter is for generating a DC voltage according to a DC dimming code signal to control the first current source. The switch includes a first terminal coupled to a second terminal of the light emitting module. The second current source includes a first terminal coupled to a second terminal of the switch. The PWM generator is for generating a PWM voltage according to the PWM dimming code signal to control the second current source.

13 Claims, 8 Drawing Sheets

(58) Field of Classification Search
CPC ... G09G 2320/0257; G09G 2320/0276; G09G 2320/041; G09G 2320/0693; G09G 2330/06; G09G 2330/08; G09G 2340/16; G09G 2360/16; G09G 3/2014; G09G 3/2074; G09G 3/30; G09G 3/32; G09G 3/325; G09G 3/3283
See application file for complete search history.

| Dimming code | | DC code | PWM code |
|---|---|---|---|
| 0000000000100000 | 32 | 2 | 0 |
| 0000000000011111 | 31 | 1 | 15 |
| 0000000000011110 | 30 | 1 | 14 |
| 0000000000010010 | 18 | 1 | 2 |
| 0000000000010001 | 17 | 1 | 1 |

FIG. 2A

HIGH RESOLUTION DIMMER CIRCUIT

CROSS REFERENCE TO RELATED APPLICATIONS

This application claims the benefit of U.S. Provisional Application No. 63/263,744, filed on Nov. 8, 2021. The content of the application is incorporated herein by reference.

BACKGROUND OF THE INVENTION

1. Field of the Invention

The present invention is related to a dimmer circuit, and more particularly to a high resolution dimmer circuit.

2. Description of the Prior Art

Various types of displays, such as liquid crystal display (LCD), organic light emitting diode (OLED) display, etc., can be implemented to electronic devices such as televisions, computers, and handheld devices. LCDs typically include a backlight to provide illumination to the liquid crystal layer, and circuitry to control the brightness and color of the pixels to render the desired image.

Light emitting diodes (LED) are widely used in displays due to their small size, low power consumption, high luminous efficiency, long lifespan and many other advantages. LED dimming technology mainly includes analog dimming and pulse-width modulation (PWM) dimming.

PWM dimming works by changing the duty cycle of the PWM current. For example, 50% brightness can be achieved by applying 100% amplitude of driving current at 50% duty cycle. Therefore, the display is not actually on at all time, but flickers at high frequency between on and off. Human eyes have persistent vision, so it would appear that the display is always on to human eyes. PWM dimming is to adjust the brightness of the display by controlling the frequency of on and off. If the display is turned on for a longer time and turned off for a shorter time in the same cycle, the overall screen would appear to be brighter. If the display is turned on for a shorter time and turned off for a longer time in the same cycle, the overall screen would appear to be darker. If the screen flickering frequency is lower than a certain frequency, it may discomfort the human eyes and cause other health issues. The analog dimming is to change the brightness of the screen by increasing or decreasing the power applied to the LED driving circuit. The brightness of the display can be adjusted only by adjusting the voltage or current. For example, applying 50% amplitude of the driving current can achieve 50% brightness. The advantage of analog dimming is that it is less burdensome for the human eyes. The disadvantage is that the brightness uniformity of the display is not as good as that of PWM dimming.

SUMMARY OF THE INVENTION

The embodiment provides a dimmer circuit for dimming according to a dimming code. The dimmer circuit includes a light emitting module for emitting light according to a driving current, a first current source, a digital-to-analog converter (DAC), a switch, a second current source and a pulse width modulation (PWM) generator. The light emitting module includes a first terminal for receiving a supply voltage, and a second terminal. The first current source includes a first terminal coupled to the second terminal of the light emitting module, a second terminal coupled to a ground terminal, and a control terminal. The digital-to-analog converter is coupled to the control terminal of the first current source, for generating a direct current (DC) voltage according to a DC dimming code signal to control the first current source. The switch includes a first terminal coupled to the second terminal of the light emitting module, a second terminal, and a control terminal. The second current source includes a first terminal coupled to the second terminal of the switch and a second terminal coupled to the ground terminal. The pulse width modulation (PWM) generator is coupled to the control terminal of the switch, for generating a PWM voltage according to a PWM dimming code signal to control the second current source. The DC dimming code signal includes the most significant bit (MSB) of the dimming code, and the PWM dimming code signal includes the least significant bit (LSB) of the dimming code.

The embodiment provides another dimmer circuit for dimming according to a dimming code. The dimmer circuit includes a light emitting diode, a first current source, a digital-to-analog converter (DAC), a switch, a second current source and a pulse width modulation (PWM) generator. The light emitting diode includes a first terminal for receiving a supply voltage, and a second terminal. The first current source includes a first terminal coupled to the second terminal of the light emitting module, a second terminal coupled to a ground terminal, and a control terminal. The digital-to-analog converter is coupled to the control terminal of the first current source, for generating a direct current (DC) voltage according to a DC dimming code signal to control the first current source. The switch includes a first terminal coupled to the second terminal of the light emitting module, a second terminal, and a control terminal. The second current source includes a first terminal coupled to the second terminal of the switch and a second terminal coupled to the ground terminal. The pulse width modulation (PWM) generator is coupled to the control terminal of the switch, for generating a PWM voltage according to a PWM dimming code signal to control the second current source. The DC dimming code signal includes the most significant bit (MSB) of the dimming code, and the PWM dimming code signal includes the least significant bit (LSB) of the dimming code.

The embodiment provides another dimmer circuit for dimming according to a dimming code. The dimmer circuit includes a light emitting module for emitting light according to a driving current, a first current source, a digital-to-analog converter (DAC), a second current source and a controller. The light emitting module includes a first terminal for receiving a supply voltage, and a second terminal. The first current source includes a first terminal coupled to the second terminal of the light emitting module, a second terminal coupled to a ground terminal, and a control terminal. The digital-to-analog converter is coupled to the control terminal of the first current source, for generating a direct current (DC) voltage according to a DC dimming code signal to control the first current source. The second current source includes a first terminal coupled to the second terminal of the light emitting module, a second terminal coupled to the ground terminal, and a control terminal. The controller is coupled to the control terminal of the second current source, for generating a control voltage according to a PWM dimming code signal to control the second current source. The DC dimming code signal includes the most significant bit (MSB) of the dimming code, and the PWM dimming code signal includes the least significant bit (LSB) of the dimming code.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIGS. 2A-2B are diagrams of the dimming codes and the corresponding driving current of the dimmer circuit in FIG. 1.

DETAILED DESCRIPTION

Figure 1:
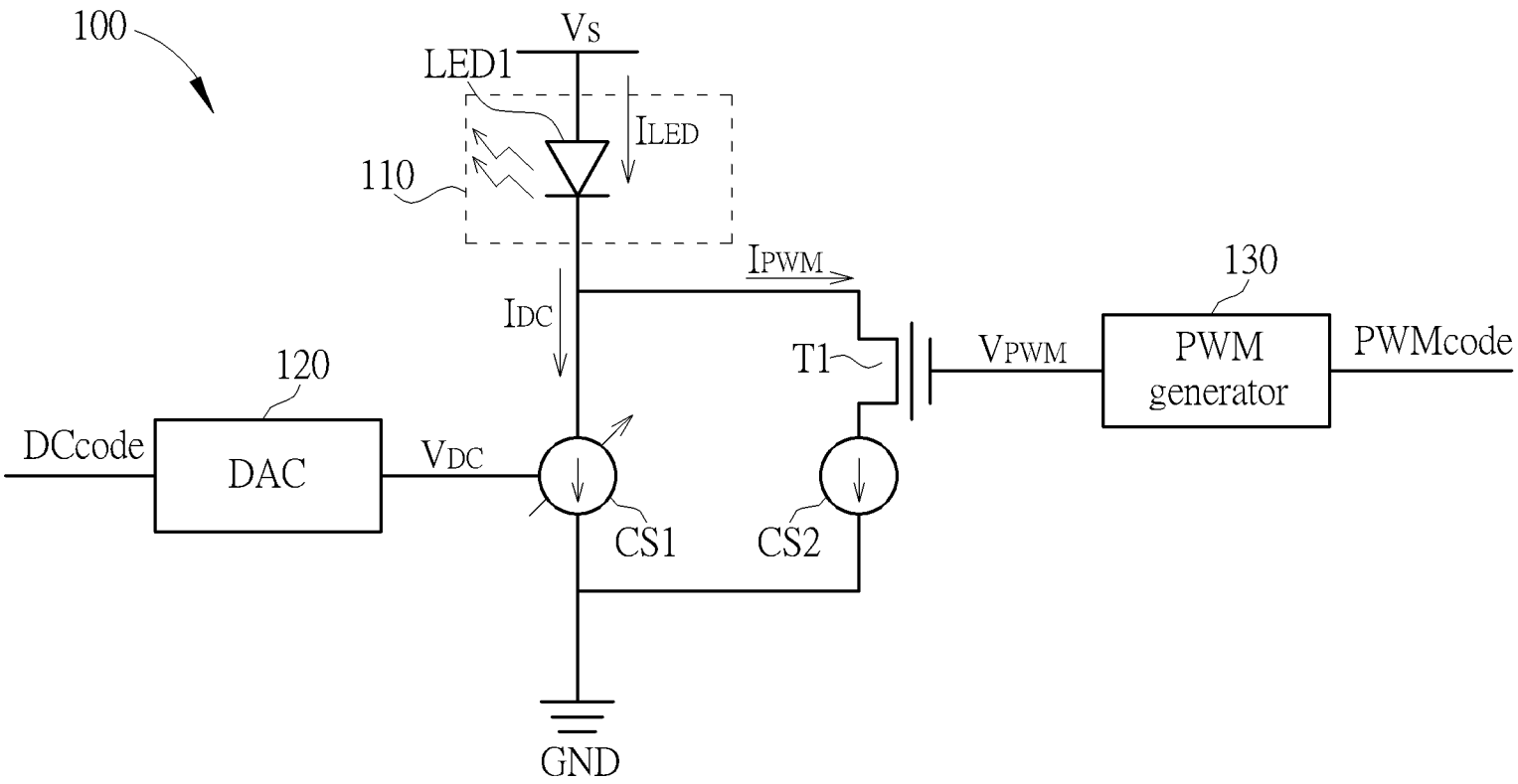
FIG. 1 is a diagram of a dimmer circuit of an embodiment of the present invention.

FIG. 1 is a diagram of a dimmer circuit 100 of an embodiment of the present invention. The dimmer circuit 100 is for dimming according to a dimming code. The dimmer circuit 100 includes a light emitting module 110 for emitting light according to a driving current $I_{LED}$, a first current source CS1, a digital-to-analog converter (DAC) 120, a switch T1, a second current source CS2 and a pulse width modulation (PWM) generator 130. The light emitting module 110 includes a first terminal for receiving a supply voltage Vs, and a second terminal. The first current source CS1 includes a first terminal coupled to the second terminal of the light emitting module 110, a second terminal coupled to a ground terminal GND, and a control terminal. The digital-to-analog converter 120 is coupled to the control terminal of the first current source CS1, for generating a direct current (DC) voltage $V_{DC}$ according to a DC dimming code signal DCcode to control the first current source CS1. The switch T1 includes a first terminal coupled to the second terminal of the light emitting module 110, a second terminal, and a control terminal. The second current source CS2 includes a first terminal coupled to the second terminal of the switch T1 and a second terminal coupled to the ground terminal GND. The PWM generator 130 is coupled to the control terminal of the switch T1, for generating a PWM voltage $V_{PWM}$ according to a PWM dimming code signal PWMcode to control the second current source CS2. The DC dimming code signal DCcode includes the higher bits of the dimming code, and the higher bits include the most significant bit (MSB) of the dimming code. The PWM dimming code signal PWMcode includes the lower bits of the dimming code, and the lower bits include the least significant bit (LSB) of the dimming code. In application, the light emitting module 110 may include a light emitting diode LED1. A first terminal of the light emitting diode LED1 can receive the supply voltage Vs, and the second terminal can be coupled to the first terminal of the first current source CS1. The switch T1 can be an N-type transistor or other equivalent components.

The driving current $I_{LED}$ for driving the light emitting diode LED1 is controlled by the first current source CS1 and the second current source CS2. The DC current $I_{DC}$ and the PWM current $I_{PWM}$ are added together to form the driving current $I_{LED}$, and the brightness of the light emitting diode LED1 is determined by the driving current $I_{LED}$. The first current source CS1 is directly controlled by the DC voltage $V_{DC}$ to provide the DC current $I_{DC}$. When the DC voltage $V_{DC}$ increases, the DC current $I_{DC}$ would also increase. As the result, the brightness of the light emitting diode LED1 would also increase. The PWM voltage $V_{PWM}$ can control the switch T1, thereby controlling the second current source CS2 and providing the PWM current $I_{PWM}$. Specifically, when the PWM voltage $V_{PWM}$ is at the high level, the switch T1 is turned on to generate the PWM current $I_{PWM}$. When the PWM voltage $V_{PWM}$ is at the low level, the switch T1 is turned off and the PWM current $I_{PWM}$ is turned off. In other words, the higher the duty ratio of the PWM voltage $V_{PWM}$ is, the longer time the PWM current $I_{PWM}$ can be turned on, which results in higher brightness of the light emitting diode LED1. The control method for the dimmer circuit 100 to generate the driving current $I_{LED}$ according to the dimming code is described in detail in the following paragraphs.

Figure 2B:
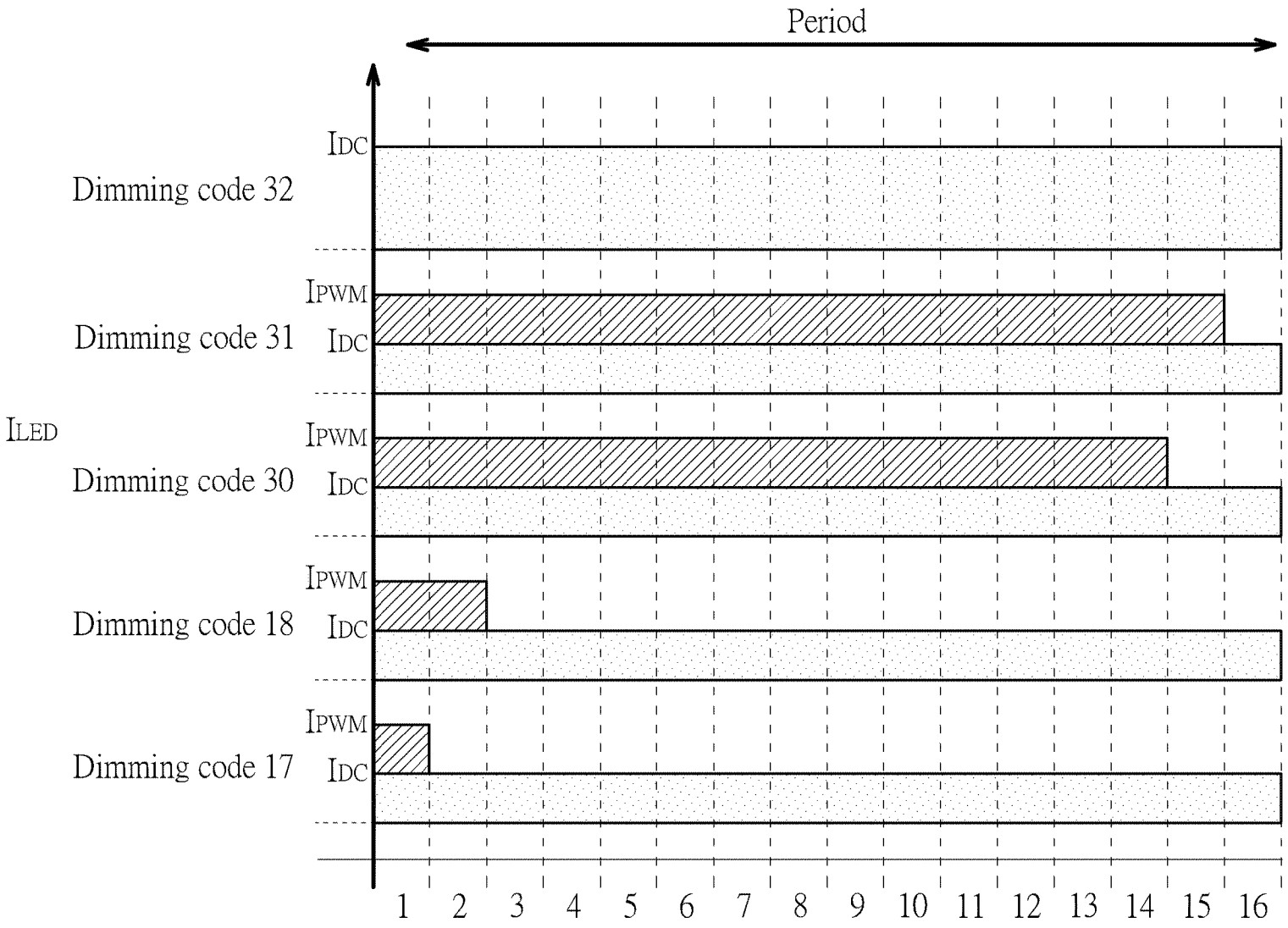

FIGS. 2A-2B are diagrams of the dimming codes and the corresponding driving current $I_{LED}$ of the dimmer circuit 100 in FIG. 1. The dimming code shown in FIG. 2A is a 16-bit code, including a 12-bit DC code and a 4-bit PWM code. The DC code includes the higher 12 bits of the dimming code, which includes the most significant bit of the dimming code. The PWM code includes the lower 4 bits of the dimming code, which includes the least significant bit of the dimming code. The vertical axis shown in FIG. 2B is the drive current $I_{LED}$, and the horizontal axis is the period, which is divided into 16 time slots. When the dimming code is input to the dimmer circuit 100, the DC code and the PWM code can be processed separately. For example, the dimming code 32 (binary: 0000000000100000) can be converted into a DC code equal to 2, and the dimmer circuit 100 can generate DC current $I_{DC}$ of 2 mA for 16 time slots. The PWM code is equal to 0, so PWM current $I_{PWM}$ is generated. The dimming code 31 (binary: 0000000000011111) can be converted into a DC code equal to 1 and a PWM code equal to 15. The dimmer circuit 100 can generate DC current $I_{DC}$ of 1 mA for 16 time slots, and PWM current $I_{PWM}$ of 1 mA for 15 time slots. The dimming code 18 (binary: 0000000000010010) can be converted into a DC code equal to 1 and a PWM code equal to 2. The dimmer circuit 100 can generate DC current $I_{DC}$ of 1 mA for 16 time slots, and PWM current $I_{PWM}$ of 1 mA for 2 time slots. Dimming code 17 (binary: 0000000000010001) can be converted into DC code equal to 1 and PWM code equal to 1. The dimmer circuit 100 can generate DC current $I_{DC}$ of 1 mA for 16 time slots, and PWM current $I_{PWM}$ of 1 mA for 1 time slot, and so on. The total current summed by the DC current $I_{DC}$ and the PWM current $I_{PWM}$ is the driving current $I_{LED}$. By this way, the brightness of the light emitting diode LED1 generated by the dimming code 32 is higher than that of the dimming code 31, and the brightness of the light emitting diode LED1 generated by the dimming code 18 is higher than that of the dimming code 17.

The DC code can be converted into a DC dimming code signal DCcode and input to the digital-to-analog converter 120, and the digital-to-analog converter 120 converts the DC dimming code signal DCcode into the DC voltage $V_{DC}$ which can control the first current source CS1 to provide DC current $I_{DC}$. The PWM code can be converted into a PWM dimming code signal PWMcode and input to the PWM generator 130. Then, the PWM generator 130 converts the PWM dimming code signal PWMcode into the PWM voltage $V_{PWM}$. The PWM voltage $V_{PWM}$ switches the switch T1 rapidly, so that the second current source CS2 provides a PWM current $I_{PWM}$ with PWM waveform.

Figure 3:
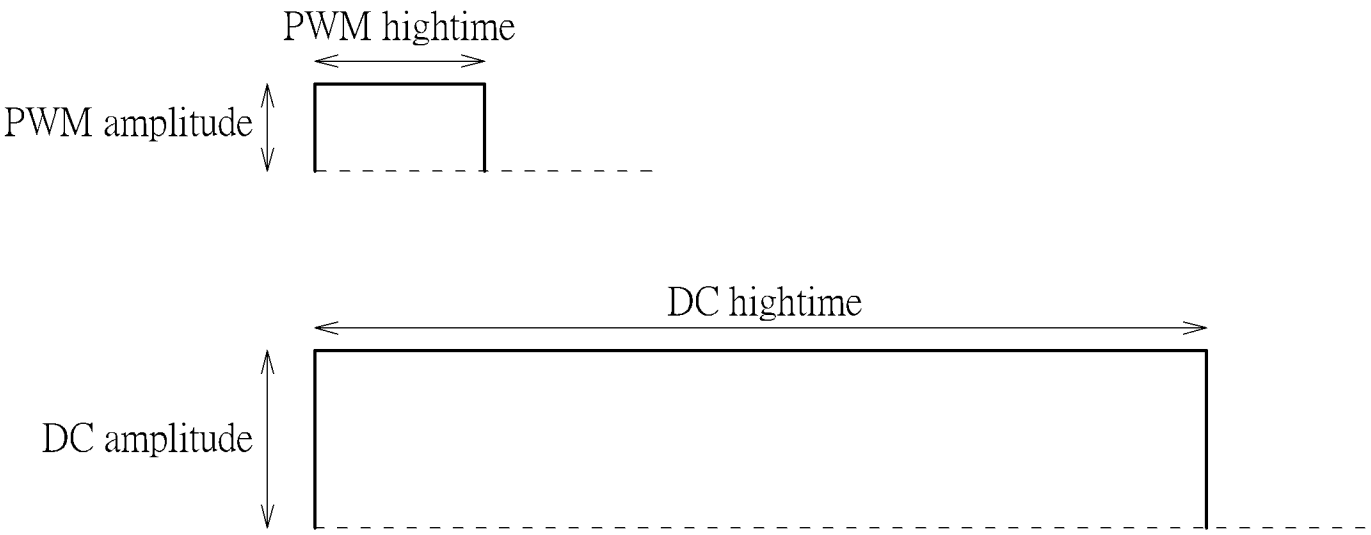
FIG. 3 is a diagram of the waveforms of the DC current and the PWM current of the dimmer circuit of FIG. 1.

FIG. 3 is a diagram of the waveforms of the DC current $I_{DC}$ and the PWM current $I_{PWM}$ of the dimmer circuit 100 of FIG. 1. The waveform formula of the DC current $I_{DC}$ is as follows:

$$\text{DC Amplitude} = \frac{I_{LEDMAX}}{2^{(DC_resolution)} - 1} \times \text{DC_code}$$

$$\text{DC Hightime} = 100\% \text{ Period}$$

$I_{LEDMAX}$ is the maximum driving current of the light emitting diode LED1. DC_code is the DC code value. DC_resolution is the number of bits of the DC code. In this embodiment, the DC code is 12 bits. DC Hightime is the duration of the DC current at high level. In this case, it equals to 100% of the period, and the period can be 16 time slots.

The waveform formula of the PWM current $I_{PWM}$ is as follows:

$$PWM \text{ Amplitude} = \frac{I_{LEDMAX}}{2^{(DC_resolution)} - 1}$$

$$PWM \text{ Hightime} = \frac{\text{Period}}{2^{(PWM_resolution)}} \times \text{PWM_code}$$

$I_{LEDMAX}$ is the maximum driving current of the light emitting diode LED1. PWM_code is the PWM code value. PWM_resolution is the number of bits of the PWM code. DC_resolution is the number of bits of the DC code. PWM Hightime is the duration of the PWM current at high level. In this embodiment, the DC code is 12 bits and PWM code is 4 bits. The period can be 16 time slots. The waveform shown in FIG. 3 can be obtained using the above formulas.

A 16-bit dimming code is considered to be high resolution (having more bits) in the field. If solely applying the analog dimming method to a 16-bit dimming code to adjust the brightness of the light emitting diode LED1, it can easily produce uneven color. Furthermore, the circuit structure of the 16-bit digital-to-analog converter (DAC) requires more transistors, and the circuit area of the DAC is too large to be effectively integrated into a small-size chip. On the other hand, if solely applying the PWM dimming method to a 16-bit dimming code to adjust the brightness of the light emitting diode LED1, it cannot effectively provide the human eyes with linear brightness perception. Although the duty cycle of the driving current can be adjusted linearly, the visual perception does not change linearly relative to brightness. The visual perception changes logarithmically. Therefore, by integrating analog dimming and PWM dimming in the embodiment, the two mechanisms can be complemented to achieve the best effect. The present invention includes, but is not limited to, 16 bits, and other numbers of bits shall fall within the scope of the present invention.

Figure 4:
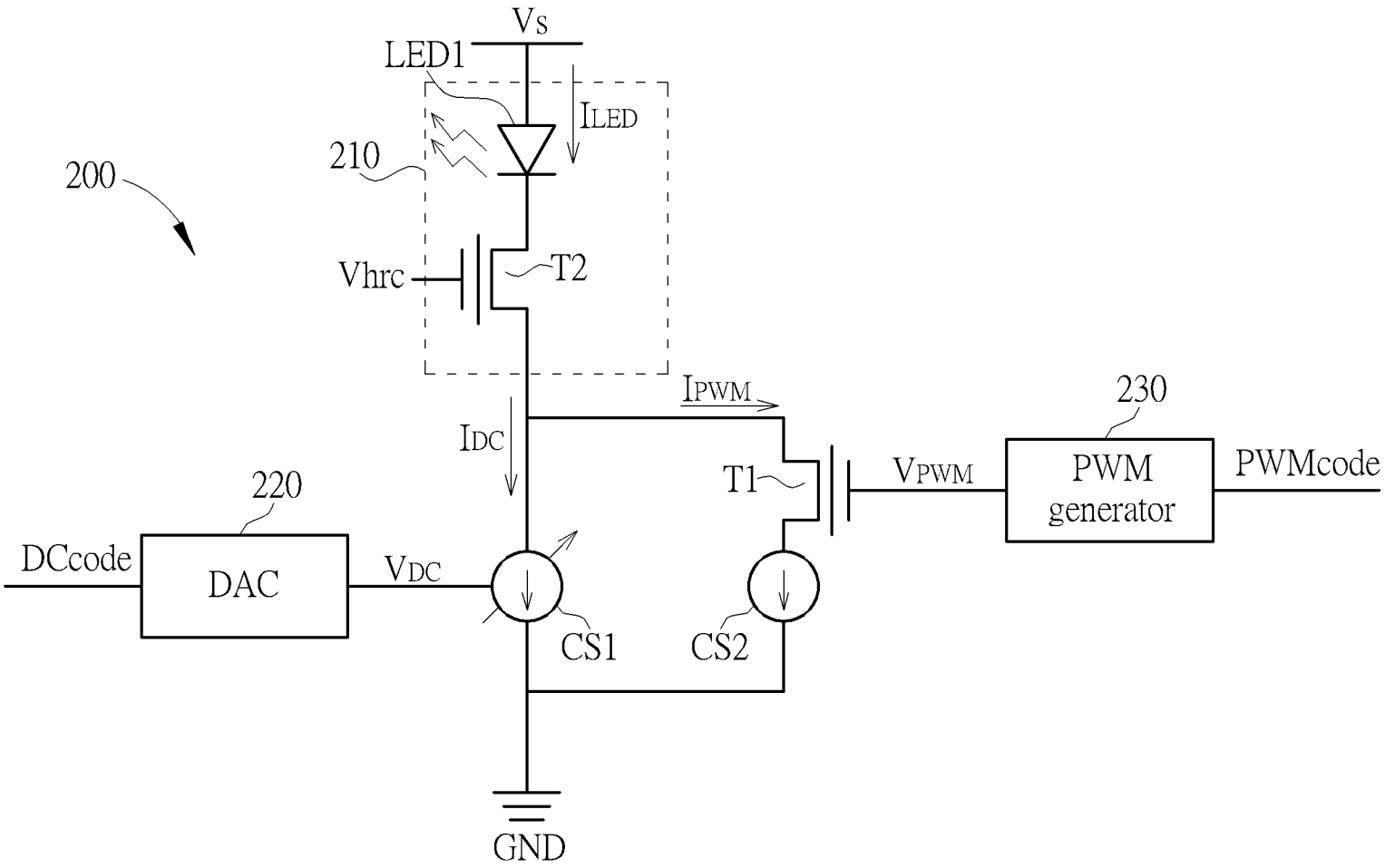
FIG. 4 is a diagram of a dimmer circuit of another embodiment.

FIG. 4 is a diagram of a dimmer circuit 200 of an embodiment. The dimmer circuit 200 is for dimming according to a dimming code. The dimmer circuit 200 includes a light emitting module 210 for emitting light according to a driving current $I_{LED}$, a first current source CS1, a digital-to-analog converter (DAC) 220, a switch T1, a second current source CS2 and a pulse width modulation (PWM) generator 230. The light emitting module includes a first terminal for receiving a supply voltage Vs, and a second terminal. The first current source CS1 includes a first terminal coupled to the second terminal of the light emitting module 210, a second terminal coupled to a ground terminal GND, and a control terminal. The digital-to-analog converter 220 is coupled to the control terminal of the first current source CS1, for generating a direct current (DC) voltage $V_{DC}$ according to a DC dimming code signal DCcode to control the first current source CS1. The switch T1 includes a first terminal coupled to the second terminal of the light emitting module 210, a second terminal, and a control terminal. The second current source CS2 includes a first terminal coupled to the second terminal of the switch T1 and a second terminal coupled to the ground terminal GND. The PWM generator 230 is coupled to the control terminal of the switch T1, for generating a PWM voltage $V_{PWM}$ according to a PWM dimming code signal PWMcode to control the second current source CS2. The DC dimming code signal DCcode includes the higher bits of the dimming code, and the higher bits include the most significant bit (MSB) of the dimming code. The PWM dimming code signal PWMcode includes the lower bits of the dimming code, and the lower bits include the least significant bit (LSB) of the dimming code. The switch T1 can be an N-type transistor or other equivalent components. The DC current $I_{DC}$ and the PWM current $I_{PWM}$ are summed up to form the driving current $I_{LED}$, and the brightness of the light emitting diode LED1 is determined by the driving current $I_{LED}$.

The difference between the dimmer circuit 200 and the dimmer circuit 100 is that the dimmer circuit 200 includes headroom control mechanism. The light emitting module 210 may include a light emitting diode LED1 and a headroom control transistor T2. The first terminal of the light emitting diode LED can receive the supply voltage Vs. The first terminal of the headroom control transistor T2 is coupled to the second terminal of the light emitting diode LED. The second terminal is coupled to the first terminal of the first current source CS1, and the control terminal is for receiving a headroom control voltage Vhrc. The headroom control mechanism can control the voltage of the light emitting module 210 to a roughly fixed value or less than a threshold value to reduce power consumption. The headroom control voltage Vhrc needs to be dynamically adjusted according to the voltage at the second terminal of the light emitting module 210 to control forward voltage sliding of the light emitting diode LED1.

In other words, the headroom control voltage Vhrc is a feedback mechanism. When the PWM voltage $V_{PWM}$ varies, the voltage jitter of the light emitting module 210 can be somewhat large. At this time, the dimmer circuit 200 can adjust the headroom control voltage Vhrc to cause the voltage of the light emitting module 210 maintained at a roughly fixed value. In other words, the headroom control transistor T2 can be regarded as a variable resistor of a low dropout voltage regulator, and its resistance is adjustable by the headroom control voltage Vhrc to reduce the power consumption of the dimmer circuit 200 and prolong the lifespan of the light emitting diode LED1.

Figure 5:
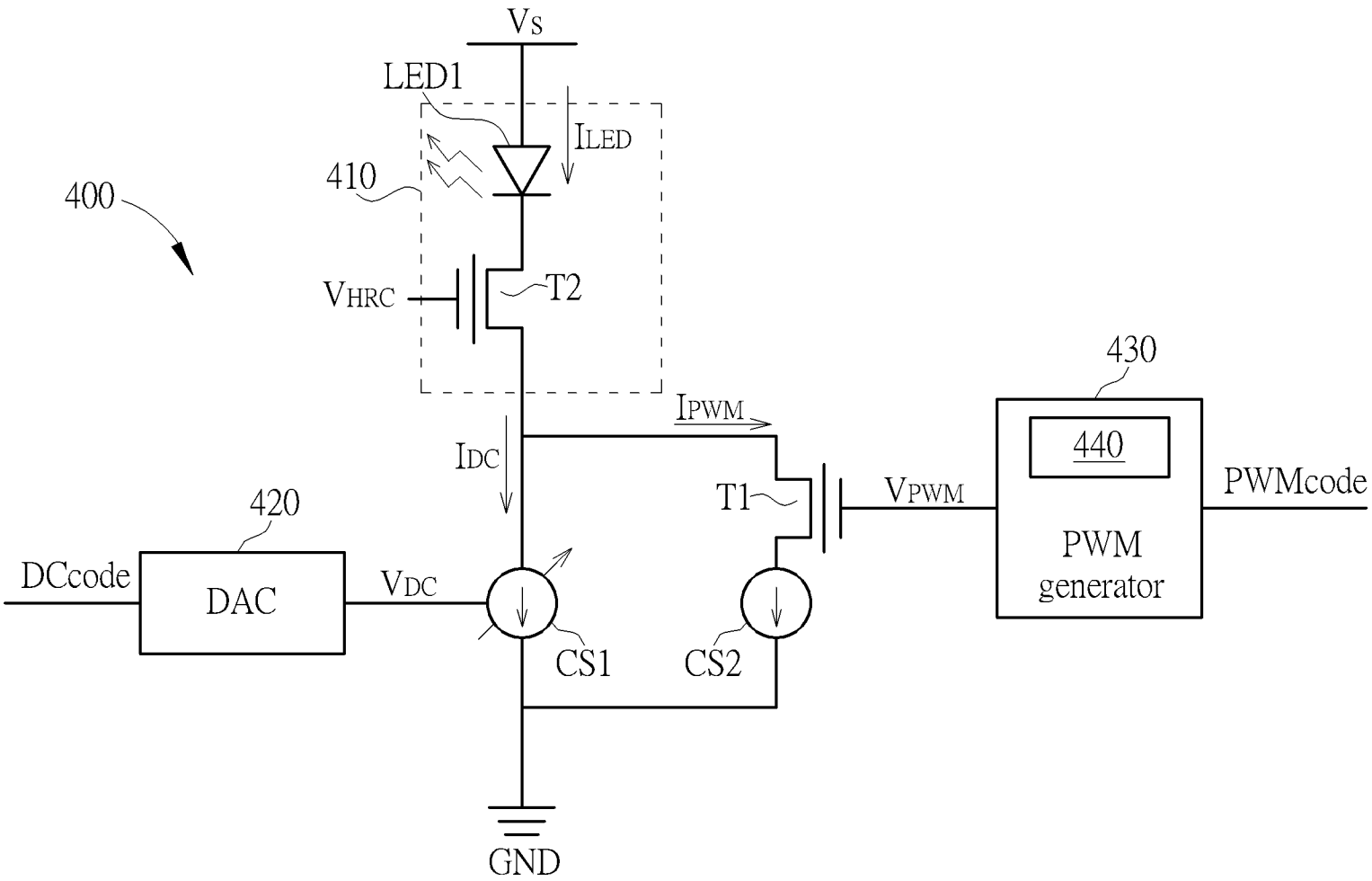
FIG. 5 is a diagram of a dimmer circuit of another embodiment.

FIG. 5 is a diagram of a dimmer circuit 400 of an embodiment. The dimmer circuit 400 is for dimming according to a dimming code. The dimmer circuit 400 includes a light emitting module 410 for emitting light according to a driving current $I_{LED}$, a first current source CS1, a digital-to-analog converter (DAC) 420, a switch T1, a second current source CS2 and a pulse width modulation (PWM) generator 430. The light emitting module includes a first terminal for receiving a supply voltage Vs, and a second terminal. The first current source CS1 includes a first terminal coupled to the second terminal of the light emitting module 410, a second terminal coupled to a ground terminal GND, and a control terminal. The digital-to-analog converter 420 is coupled to the control terminal of the first current source CS1, for generating a direct current (DC) voltage $V_{DC}$ according to a DC dimming code signal DCcode to control the first current source CS1. The switch T1 includes a first terminal coupled to the second terminal of the light emitting module 410, a second terminal, and a control terminal. The second current source CS2 includes a first terminal coupled to the second terminal of the switch T1 and a second terminal coupled to the ground terminal GND. The PWM generator 430 is coupled to the control terminal of the switch T1, for generating a PWM voltage $V_{PWM}$ according to a PWM dimming code signal PWMcode to control the second current source CS2. The DC dimming code signal DCcode includes the higher bits of the dimming code, and the higher bits include the most significant bit (MSB) of the dimming code. The PWM dimming code signal PWMcode includes the lower bits of the dimming code, and the lower bits include the least significant bit (LSB) of the dimming code. In application, the light emitting module 410 may include a light emitting diode LED1. A first terminal of the light emitting diode LED1 can receive the supply voltage Vs, and the second terminal can be coupled to the first terminal of the first current source CS1. The switch T1 can be an N-type transistor or other equivalent components. The DC current $I_{DC}$ and the PWM current $I_{PWM}$ are summed up to form the driving current $I_{LED}$, and the brightness of the light emitting diode LED1 is determined by the driving current $I_{LED}$.

The difference between the dimmer circuit 400 and the dimmer circuit 100 is that the PWM generator 430 may include a digital circuit 440, such as a look-up table. The look-up table can be implemented as hardware, such as a read-only memory, application specific integrated circuit (ASIC) or other forms of digital circuits. The digital circuit 440 can be used to generate dithering. By adding dithering (i.e., spread spectrum clock generation) to the PWM voltage $V_{PWM}$, the quantization error and the audible frequency interference can be reduced, thereby making the dimmer circuit 400 generating more accurate brightness. The digital circuit 440 can also apply the same technique (i.e., spread spectrum clock generation) to reduce the electromagnetic interference (EMI) generated by the PWM voltage $V_{PWM}$.

The digital circuit 440 can also be used to generate phase-shift for the PWM voltage $V_{PWM}$, so that the rising edges and falling edges of the PWM voltages $V_{PWM}$ of a plurality of dimmer circuits 400 can be staggered. For example, a 16-channel driving device has a plurality of dimmer circuits 400 integrated into an integrated circuit. If all PWM voltages $V_{PWM}$ of the plurality of dimmer circuits 400 rise or fall simultaneously, the circuit voltage would change rapidly, causing the circuit to exceed its maximum loading. Adding phase-shift to the PWM voltage $V_{PWM}$ can avoid the above-mentioned situation, thereby making the dimmer circuit 400 to operate more robustly.

Figure 6:
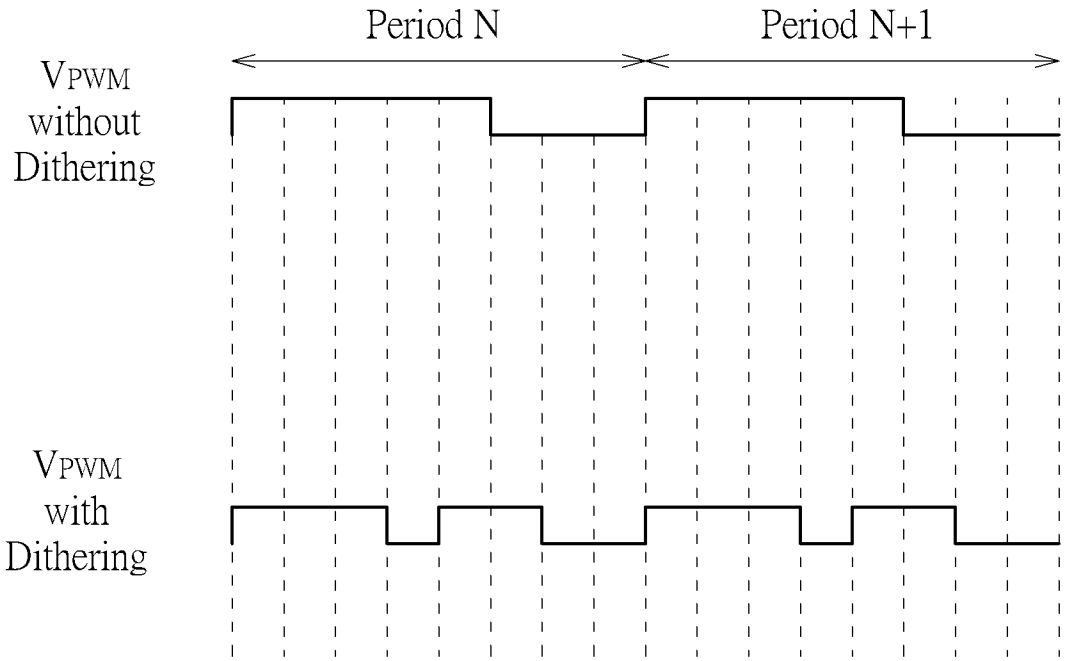
FIG. 6 is a diagram of the PWM voltage of the dimmer circuit of FIG. 5.

FIG. 6 is a diagram of the PWM voltage $V_{PWM}$ of the dimmer circuit 400 of FIG. 5. The upper portion of FIG. 6 is the PWM voltage $V_{PWM}$ without dithering, and the lower portion is the PWM voltage $V_{PWM}$ with dithering. For example, the digital circuit 440 can apply the spread spectrum clock generation (SSCG) technique to break up the frequency spectrum of the PWM voltage $V_{PWM}$. As shown in the lower portion of FIG. 6, both period N and period N+1 have 3+2 waveforms. This type of waveform can reduce quantization errors and audible frequency interference. In addition, the digital circuit 440 can also produce other types of waveforms in the same principle to reduce the high-frequency electromagnetic interference (EMI) in the dimmer circuit 400. Thus, applying the digital circuit 440 to add dithering can make the driving current $I_{LED}$ more robust, reducing the flickers of the light emitting diode LED1 and producing more accurate brightness.

A supplemental description here is for explaining spread spectrum clock generation (SSCG). Spread spectrum clock generation technique is an application of frequency modulation. The basic principle of the spread spectrum clock generation is to slightly modulate the frequency of a signal, so that the energy of the signal is dispersed into a small controllable range. After the modulation, the peak energy of each harmonic in the spectrum would be attenuated. Therefore, the applying spread spectrum clock generation can effectively reduce the electromagnetic interference or audible frequency interference of the signal.

Figure 7:
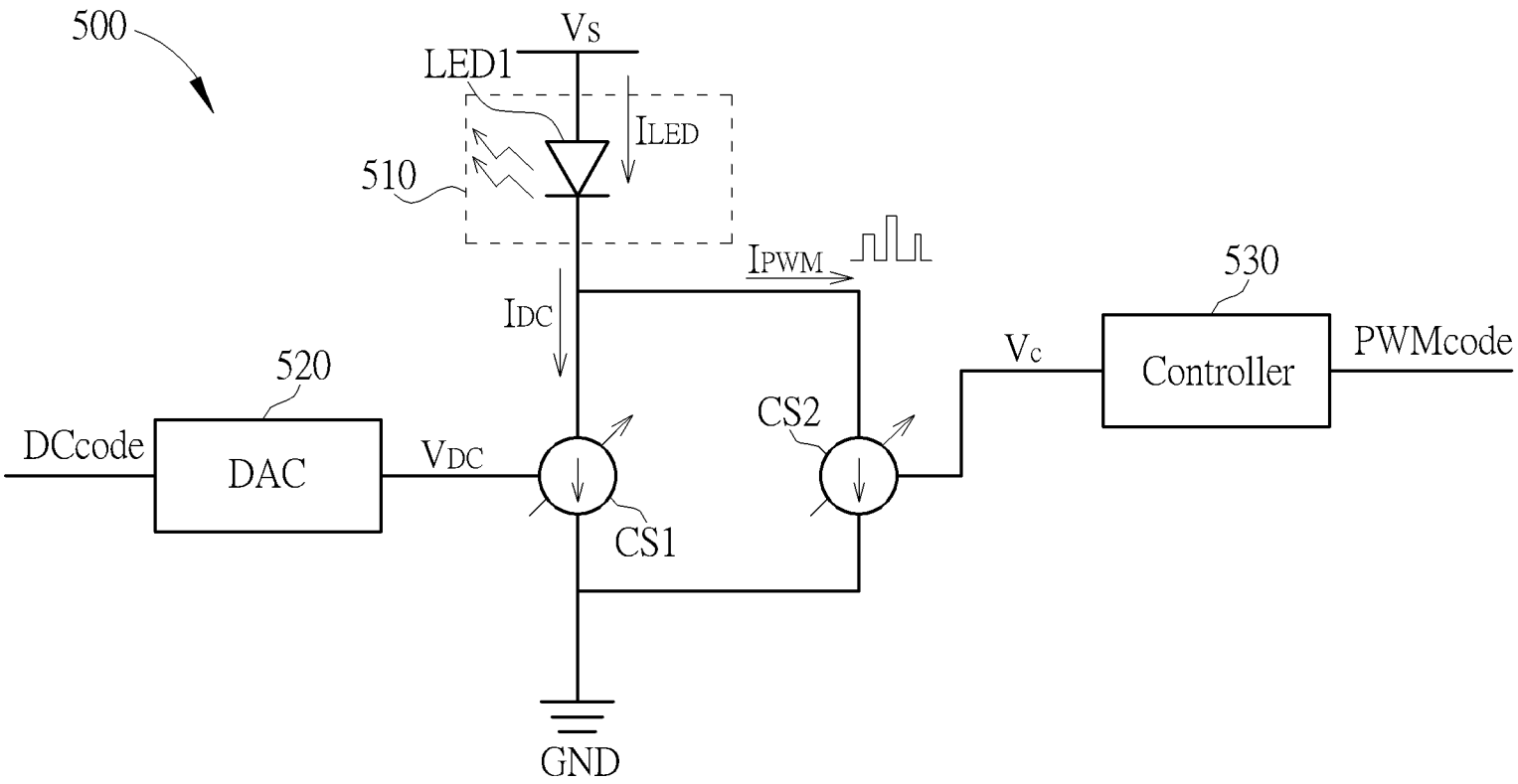
FIG. 7 is a diagram of a dimmer circuit of another embodiment.

FIG. 7 is a diagram of a dimmer circuit 500 of an embodiment. The dimmer circuit 500 is for dimming according to a dimming code. The dimmer circuit 500 includes a light emitting module 510 for emitting light according to a driving current $I_{LED}$, a first current source CS1, a digital-to-analog converter (DAC) 520, a switch T1, a second current source CS2 and a controller 530. The light emitting module includes a first terminal for receiving a supply voltage Vs, and a second terminal. The first current source CS1 includes a first terminal coupled to the second terminal of the light emitting module 510, a second terminal coupled to a ground terminal GND, and a control terminal. The digital-to-analog converter 520 is coupled to the control terminal of the first current source CS1, for generating a direct current (DC) voltage $V_{DC}$ according to a DC dimming code signal DCcode to control the first current source CS1. The second current source CS2 includes a first terminal coupled to the second terminal of the light emitting module 510, a second terminal coupled to the ground terminal GND, and a control terminal. The controller 530 is coupled to the control terminal of the second current source CS2, for generating a control voltage Vc according to a PWM dimming code signal PWMcode to control the second current source. The DC dimming code signal DCcode includes the higher bits of the dimming code, and the higher bits include the most significant bit (MSB) of the dimming code. The PWM dimming code signal PWMcode includes the lower bits of the dimming code, and the lower bits include the least significant bit (LSB) of the dimming code. In application, the light emitting module 510 may include a light emitting diode LED1. A first terminal of the light emitting diode LED can receive the supply voltage Vs, and the second terminal can be coupled to the first terminal of the first current source CS1. The DC current $I_{DC}$ and the PWM current $I_{PWM}$ are summed up to form the driving current $I_{LED}$, and the brightness of the light emitting diode LED1 is determined by the driving current $I_{LED}$.

The difference between the dimmer circuit 500 and the dimmer circuit 100 is that the second current source CS2 of the dimmer circuit 500 is an adjustable current source, and the controller 530 controls the PWM current $I_{PWM}$ through the control voltage Vc. Therefore, the implementation of the dimmer circuit 500 can omit the switch T1. The controller 530 can also include a digital circuit, such as a look-up table or other equivalent circuit structure. The controller 530 can convert the PWM dimming code signal PWMcode into the control voltage Vc. Further, the controller 530 can also be used to generate phase-shift for the control voltage Vc, so that the rising edges and falling edges of control voltages Vc of a plurality of dimmer circuits 500 can be staggered. For example, a 16-channel driving device can have a plurality of dimmer circuits 500 integrated into an integrated circuit. If all PWM voltages $V_{PWM}$ of the plurality of dimmer circuits 500 rise or fall simultaneously, the circuit voltage would change rapidly, causing the circuit to exceed its maximum loading. Adding phase-shift to the control voltage Vc can avoid the above-mentioned situation, thereby making the dimmer circuit 500 to operate more robustly.

Furthermore, the controller 530 can generate the control voltage Vc with different amplitudes, and control the second current source CS2 to output the PWM current $I_{PWM}$ with different amplitudes and pulse widths, so as to generate the effect of dithering. By adding dithering to the control voltage Vc, the audible frequency interference can be reduced, thereby making the dimmer circuit 500 generating more accurate brightness. The controller 530 can also apply the same technique to reduce the electromagnetic interference (EMI) in the dimmer circuit 500, so as to make the driving current $I_{LED}$ more stable, reducing flickering of the light emitting diode LED1.

In summary, the dimmer circuits of the above-mentioned various embodiments of the present invention can divide a high resolution dimming code into a DC code and a PWM code, which respectively include higher bits and lower bits of the dimming code. As described, this can simplify control variables, reduce voltage variation and reduce error rate. The layout size of the dimmer circuit can also be reduced, thus reducing the area occupied in an integrated circuit. The dimmer circuit of the embodiment can also implement a digital circuit to add dithering to suppress electromagnetic interference and other interferences, thereby improving the accuracy of brightness control.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dimmer circuit for dimming according to a dimming code, comprising:

a light emitting module configured to emit light according to a driving current, comprising:

a first terminal configured to receive a supply voltage; and a second terminal;

a first current source comprising:

a first terminal coupled to the second terminal of the light emitting module;

a second terminal coupled to a ground terminal; and a control terminal;

a digital-to-analog converter coupled to the control terminal of the first current source, and configured to generate a direct current (DC) voltage according to a DC dimming code signal to control the first current source;

a switch comprising:

a first terminal coupled to the second terminal of the light emitting module;

a second terminal; and a control terminal;

a second current source comprising:

a first terminal coupled to the second terminal of the switch; and a second terminal coupled to the ground terminal; and a pulse width modulation (PWM) generator coupled to the control terminal of the switch, and configured to generate a PWM voltage according to a PWM dimming code signal to control the second current source;

wherein the DC dimming code signal comprises a most significant bit (MSB) of the dimming code, and the PWM dimming code signal comprises a least significant bit (LSB) of the dimming code.

2. The dimmer circuit of claim 1, wherein the light emitting module comprises:

a light emitting diode comprising:

a first terminal configured to receive the supply voltage; and a second terminal; and a headroom control transistor comprising:

a first terminal coupled to the second terminal of the light emitting diode;

a second terminal coupled to the first terminal of the first current source; and a control terminal configured to receive a headroom control voltage.

3. The dimmer circuit of claim 1, wherein the PWM generator comprises a look-up table configured to generate dithering and/or phase shift for the PWM voltage.

4. The dimmer circuit of claim 1, wherein the switch is an N-type transistor.

5. The dimmer circuit of claim 1, wherein the dimming code is a 16-bit code.

6. A dimmer circuit for dimming according to a dimming code, comprising:

a light emitting diode comprising:

a first terminal configured to receive a supply voltage; and a second terminal;

a first current source, comprising:

a first terminal coupled to the second terminal of the light emitting diode;

a second terminal coupled to a ground terminal; and a control terminal;

a digital-to-analog converter coupled to the control terminal of the first current source, and configured to generate a direct current (DC) voltage according to a DC dimming code signal to control the first current source;

a switch comprising:

a first terminal coupled to the second terminal of the light emitting diode;

a second terminal; and a control terminal;

a second current source, comprising:

a first terminal coupled to the second terminal of the switch; and a second terminal coupled to the ground terminal; and a pulse width modulation (PWM) generator coupled to the control terminal of the switch, and configured to generate a PWM voltage according to a PWM dimming code signal to control the second current source;

wherein the DC dimming code signal comprises a most significant bit (MSB) of the dimming code, and the PWM dimming code signal comprises a least significant bit (LSB) of the dimming code.

7. The dimmer circuit of claim 6, wherein the PWM generator comprises a look-up table configured to generate dithering and/or phase shift for the PWM voltage.

8. The dimmer circuit of claim 6, wherein the switch is an N-type transistor.

9. The dimmer circuit of claim 6, wherein the dimming code is a 16-bit code.

10. A dimmer circuit for dimming according to a dimming code, comprising:

a light emitting module configured to emit light according to a driving current, comprising:

a first terminal configured to receive a supply voltage; and a second terminal;

a first current source comprising:

a first terminal coupled to the second terminal of the light emitting module;

a second terminal coupled to a ground terminal; and a control terminal;

a digital-to-analog converter coupled to the control terminal of the first current source, and configured to generate a direct-current (DC) voltage according to a DC dimming code signal to control the first current source;

a second current source comprising:

a first terminal coupled to the second terminal of the light emitting module; and a second terminal coupled to the ground terminal; and a control terminal; and a controller coupled to the control terminal of the second current source, and configured to generate a control voltage according to a PWM dimming code signal to control the second current source;

wherein the DC dimming code signal comprises a most significant bit (MSB) of the dimming code, and the PWM dimming code signal comprises a least significant bit (LSB) of the dimming code.

11. The dimmer circuit of claim 10, wherein the light emitting module comprises a light emitting diode, the light emitting diode comprising:

a first terminal configured to receive the supply voltage; and a second terminal coupled to the first terminal of the first current source.

12. The dimmer circuit of claim 10, wherein the controller comprises a look-up table configured to generate dithering and/or phase shift for the control voltage.

13. The dimmer circuit of claim 10, wherein the dimming code is a 16-bit code.

* * * * *